United States Patent [19]

Spiegel et al.

[11] Patent Number: 5,031,651

[45] Date of Patent: Jul. 16, 1991

[54] WATER DEFLECTOR FOR DOMESTIC DISHWASHER

[75] Inventors: Raymond W. Spiegel; Roger J. Bertsch, both of Lincoln Township, Berrien County; Geoffrey L. Dingler, St. Joseph Township, Berrien County all of Mich.

[73] Assignee: Whirlpool Corporation, Benton Harbor, Mich.

[21] Appl. No.: 460,031

[22] Filed: Jan. 3, 1990

[51] Int. Cl.[5] ..... A47L 15/42

[52] U.S. Cl. ..... 134/183

[58] Field of Search ..... 134/182, 183, 176, 179, 134/154

[56] References Cited

U.S. PATENT DOCUMENTS

| | | | |
|---|---|---|---|
| 3,496,949 | 2/1970 | Mercer | 134/179 |
| 3,575,185 | 4/1971 | Barbulesco | 134/104 |
| 3,915,182 | 10/1975 | Payne | 134/176 |

FOREIGN PATENT DOCUMENTS

| | | | |
|---|---|---|---|
| 2703295 | 8/1978 | Fed. Rep. of Germany | 134/183 |

*Primary Examiner*—Philip R. Coe

*Attorney, Agent, or Firm*—Thomas J. Roth; Stephen D. Krefman; Thomas E. Turcotte

[57] ABSTRACT

Water deflector member removably mountable to the base of a dishwasher tub in a preselected fixed position near the side edge of the door of the dishwasher such as to deflect into the tub water running down the corner between the tub side wall and the door. The preferred deflector member includes a resilient plug portion inserted into a vertical socket formed in the lower wall of the tub, a flat resilient deflector portion extending horizontally from the plug towards the door in a cantilever fashion, and a webbed portion extending in a vertical plane between the plug and the deflector portion. The webbed portion extends through a slot formed in the lower wall of the tub which further serves to drain the socket of water.

20 Claims, 2 Drawing Sheets

WATER DEFLECTOR FOR DOMESTIC DISHWASHER

BACKGROUND OF THE PRESENT INVENTION

1. Field of the Invention

The present invention is directed to a diverter diverting a column of water and more particularly to a diverter diverting a column of water adjacent an edge of the door of a domestic dishwasher.

2. Description of the Prior Art

In dishwashers and the like it is conventional to arrange the dishes, etc. to be washed on racks disposed within a tub enclosure having a vertically disposed door openable for access into the tub enclosure for insertion and removal of the dishes. A rotating spray arm is conventionally provided in the center of the lower wall of the tub for throwing cleaning liquid through spray jets throughout the interior of the tub such as to clean the dishes. A portion of the cleaning liquid is inevitably directed towards the corners of the tub and forms a column of liquid running down along the corners and into the tub. It is known to provide deflectors extending from the lower rack towards the door in the vicinity of the edges of the door to deflect the column of water away from the lower edge of the door and into the center of the lower wall of the tub. This minimizes the wear and the possibility of leakage between the tub and the lower portion of the door. By mounting the deflectors to the rack, a relatively inexpensive flapper design ma be used. However, due to the mobility of the lower rack, the deflectors are not in a fixed preselected position but instead may be less efficiently positioned relative to the column of water than is desirable. Furthermore, the flapper design is more vulnerable to damage or loss since it is located in a region more often and more easily reached by the user of the dishwasher.

What is needed therefore is a deflector retaining the advantages of the flapper design while reducing the tendency for damage, loss, or malpositioning of the flapper.

SUMMARY OF THE INVENTION

The present invention provides a flexible water deflector for deflecting a column of water, particularly a column of water adjacent to an edge of a door to dishwasher tub.

In particular, the deflector member of the present invention includes a main body having a resilient plug portion removably insertable in a vertical socket formed in the lower wall of the tub of a dishwasher, and a flat resilient deflector portion extending horizontally from the plug portion in a cantilever manner towards the door of the dishwasher.

In the preferred embodiment, the deflector of the present invention further includes a web portion extending in a vertical plane between the plug portion and the deflector portion of the main body. The webbed portion provides additional rigidity to the deflector portion. Furthermore, in the preferred embodiment, the socket is formed adjacent the rail for the lower rack of the dishwasher such that, when the plug portion is inserted into the socket, the top of the resilient deflector portion is generally co-planar with the rail. The web portion of the main body of the deflector member preferably extends through a slot formed in the lower wall of the tub adjacent the socket such that the slot provides clearance for the web portion and further serves to drain liquid from the socket.

It is a principal object of the present invention to provide an improved deflector arrangement for diverting water from the lower edge of the door of the dishwasher.

A further object of the present invention is to provide a deflector for a dishwasher which is removably connectable to the dishwasher in a predictable preselected location adjacent an edge of the door.

An additional object of the present invention is to provide a liquid deflector which is located in a less accessible and therefore less vulnerable location than prior designs.

Still another object of the present invention is to provide a deflector which is easily removable and replaceable.

A yet further object of the present invention is to provide an improved deflector which is economical to manufacture and assemble to the dishwasher.

These and other object and advantages of the present invention will become apparent to those skilled in the art when the following detailed description of the preferred embodiment is read in conjunction with the drawing appended hereto in which like reference numerals refer to like components throughout.

DESCRIPTION OF THE PREFERRED EMBODIMENT

Figure 1:
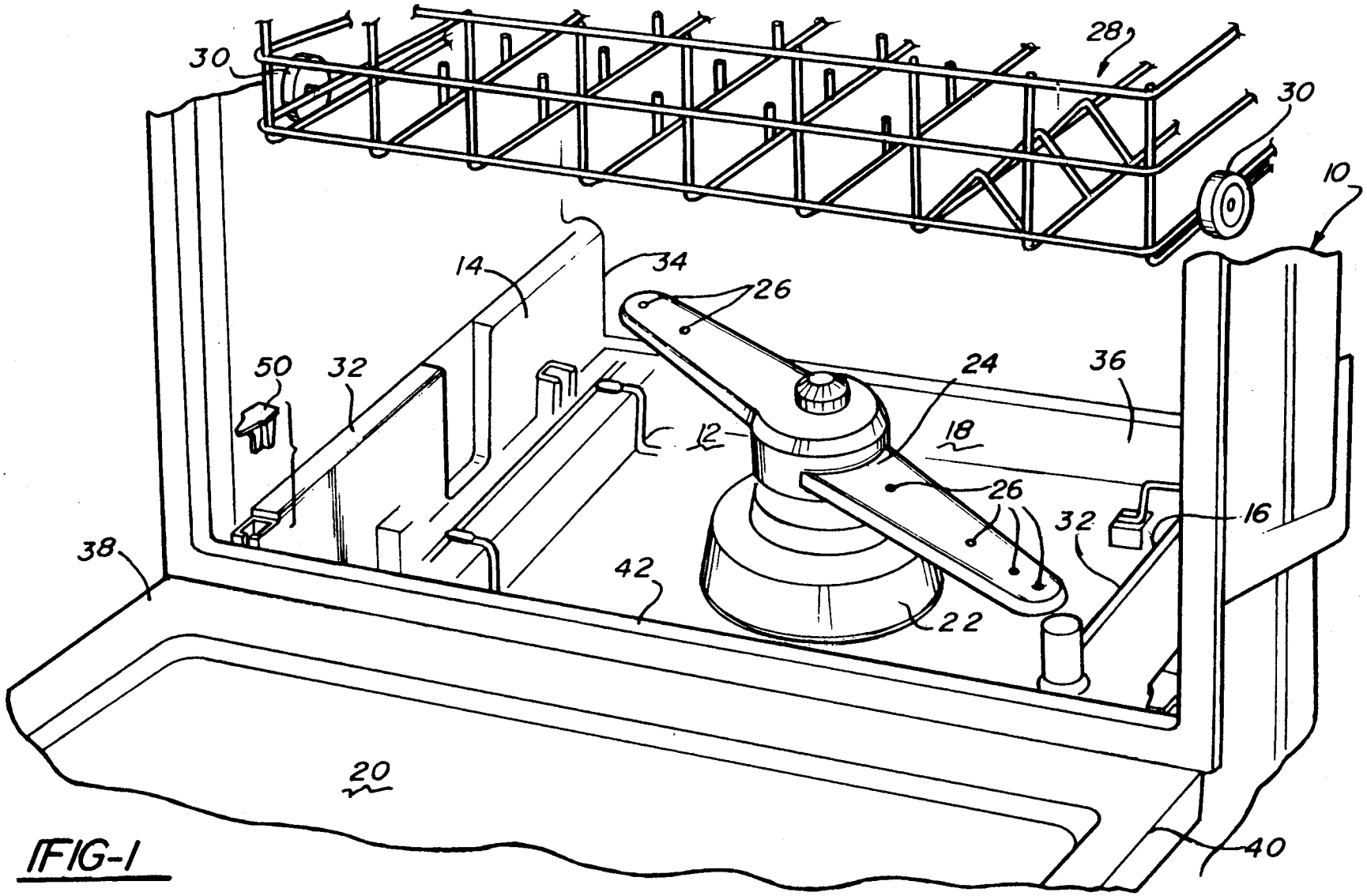
FIG. 1 is a cutaway perspective view of the lower portion of a dishwasher tub incorporating the deflector of the present invention.
Figure 2:
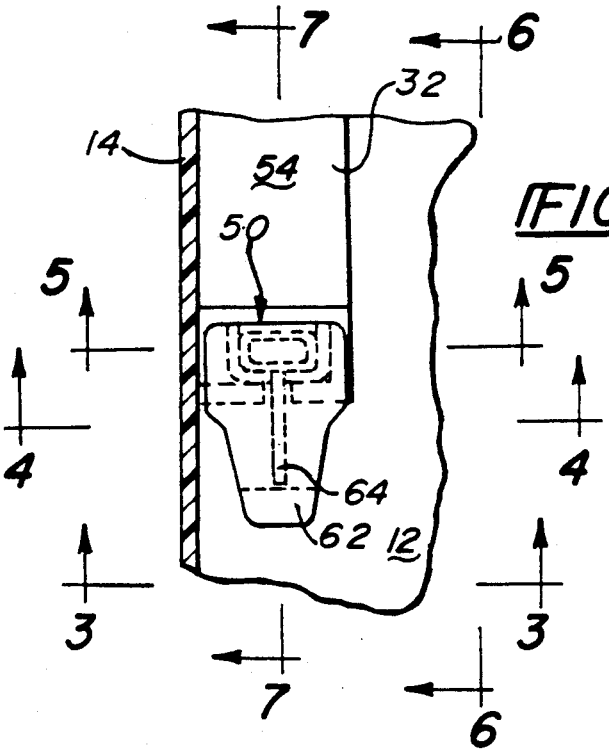
FIG. 2 is a top view of the liquid diverter member of the present invention and the portion of the dishwasher tub adjacent thereto.
Figure 3:
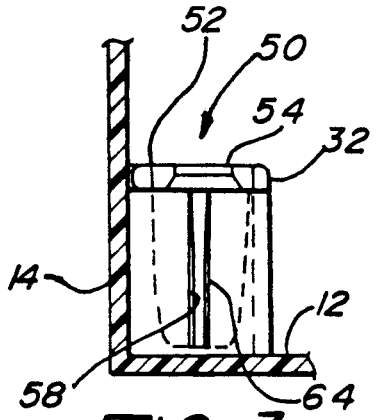
FIGS. 3 through 7 are sectional views taken along lines 3—3 through 7—7, respectively, of FIG. 2.
Figure 4:
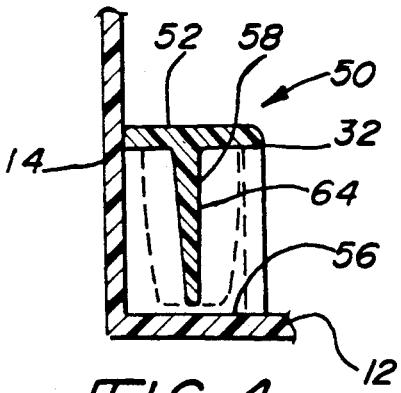
Figure 5:
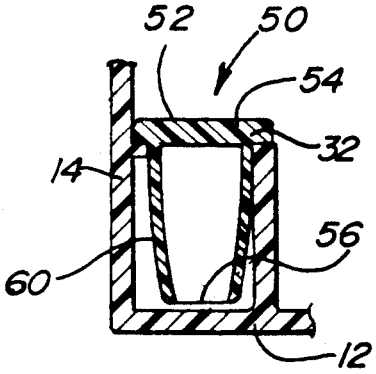
Figure 6:
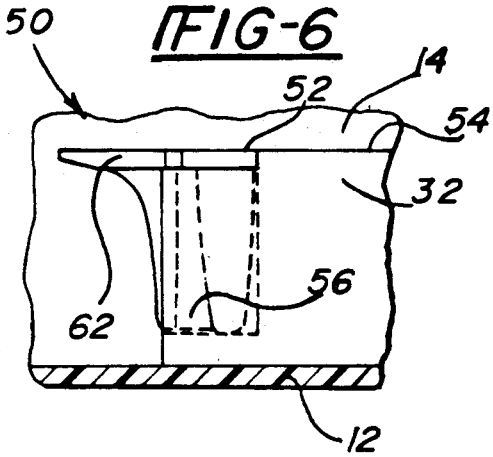
Figure 7:
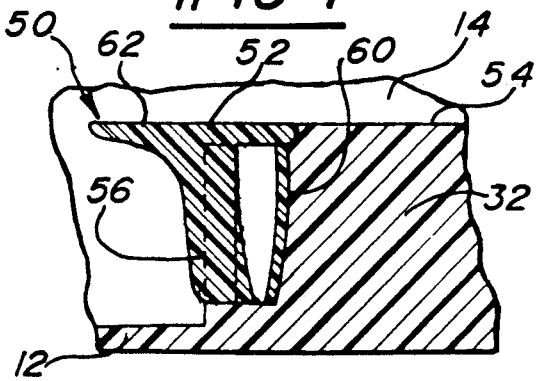

Referring now to the drawing illustrating an exemplary embodiment of the present invention for purposes of illustrating the best mode of the invention as contemplated by the inventor at the time of filing the present application and not for the purpose of limiting the present invention to such embodiment, FIG. 1 shows the lower interior portion of a dishwasher tub 10 having a lower wall 12, side walls 14 and 16 and a back wall 18. The tub 10 further has a front opening closeable by a bottom-hinged door 20 and a top wall, not shown on the drawing but well known in the art, which together with the walls 12 through 18 forms a water tight enclosure for washing dishes.

As is well known in the art, the lower wall 12 of the tub 10 includes a sump 22 having a spray arm 24 retainably mounted therein. The spray arm is supplied with pressurized washing liquid by a pump, not shown on the drawing but well known in the art. Spray arm 24 is provided with a plurality of spray apertures 26. The pressurized liquid entering the spray arm and exiting the spray arm through the spray apertures 26 causes the spray arm to rotate in reaction to the spray of liquid in a known manner. As the spray arm 24 rotates in a generally circular horizontal path, the sprayed liquid is directed generally upwardly into the interior of the tub.

A lower rack 28 is positionable within the tub 10 above the spray arm 24. The lower rack 28 includes downwardly projecting rollers 30 engageable with a track 32 formed in or mounted to the lower wall 12 of the tub. The track 32 provides a guide for the rolling movement of the rack 28 in and out of the tub 10 and onto the door 20 when the door is open. The rollers 30 support the rack 28 in a spaced position above the spray arm 24.

In a conventional dishwasher of the type described, a high velocity liquid spray passes through the rack 28 and cleans articles disposed on the rack. A portion of the liquid spray encounters the walls of the tub or encounters the door and descends into the sump 22 to be recirculated to the tub. However, because of the cubicle configuration of the tub 10, a particularly large portion of the water is directed into the corners 34, 36, 38 and 40 of the tub 10. This does not create a problem in the back corners of 34 and 36, but it creates a potential problem in the front corners 38 and 40.

More particularly, since the door 20 is hingedly mounted to the tub 10 there is a region at the lower edge 42 of the door where there is an increased risk of liquid leakage. The column of water descending along the front corners 38 and 40 would increase the wear on any seal in the vicinity of the lower edge 42 of the door and increase the risk of leakage past the seal, unless the water column is diverted. In prior art designs, a flapper, not shown on the drawing, is interconnected with the lower rack 28 and extends outwardly therefrom towards the door in the general vicinity of the corners 38 and 40 such as to divert the water column into this region of the sump 22.

The present invention, a deflector member 50 is fixedly interconnected with the lower wall 12 of the tub.

More particularly, in the preferred embodiment, the deflector member 50 is fixedly interconnected with the tub 10 adjacent the end of the track 32 closest to the door 20 such that the top surface 52 of the deflector member 50 is approximately co-planer with the top surface 54 of the track 32. As will be appreciated by those skilled in the art, this positioning permits the rack 28 to be rolled over the deflector member 50 without separating the deflector member from the tub 10 and further inhibits user access to the deflector member so as to reduce the likelihood of loss or damage to the deflector member by the user. Furthermore, as will become apparent shortly from a review of the preferred design of the deflector member, the rack 28 will tend to reconnect the deflector member 50 with the lower wall 12 of the tub 10, in the event that the deflector member should become loose, each time the rack 28 is rolled over the deflector member 50.

The details of the construction of the deflector member 50, as well as the manner in which the member 50 is interconnected with the tub 10 are shown generally in FIGS. 1 through 6 of the drawing.

The tub 10 is provided with a vertically opening socket 56 adjacent the end of the each track 32. The socket is preferably rectangular in cross section and tapered. A vertical slot 58 is formed in the lower wall 12 of the tub 10 opening into the socket 56 such as to permit drainage of liquid from the base 60 of the socket 56 The drainage of liquid from the socket 56 is desirable so as to minimize the deterioration of the deflector member from the effects of the liquid.

The deflector member 50 has a plug portion 60 which is preferably tapered and rectangular in cross-section and forms an interference fit in the socket 56. The rectangular shape of the plug facilitates proper orientation of the deflector member when installed in the dishwasher. The plug portion is also preferably hollow so as to reduce the cost of manufacturing the deflector member and so as to facilitate the deflection of the plug portion as it is removably installed in the socket 56.

The deflector member 50 further is provided with a flapper or deflector portion 62 extending perpendicular to the longitudinal axis of the plug portion 60 in a cantilever manner therefrom towards the door 20. The deflector portion 62 acts to deflect the column of water towards the sump 22.

The deflector member 50 is further provided with a web portion 64 extending in a vertical plane between the plug portion 60 and the deflector portion 62. The web portion 64 provides an additional predetermined amount of rigidity to the deflector portion 62. The web portion 64 further reduces the probability that the deflector portion 62 will be severed from the plug portion 6 of the deflector member 50 by the bending forces experienced by the deflector portion. The web portion 64 extends through the slot 58 and, therefore, acts as an additional orienting feature to assure that the deflector portion 62 of the deflector member 50 is fixed in the position in orientation most suitable for redirecting the column of water into the sump.

The present invention therefore provides an inexpensive, easily manufactured, and easily assembled dishwasher tub water deflector which may be easily replaced yet is accurately fixedly positioned in use, less likely to be inadvertently lost or damaged in use, and provides an attractive functional extension to the track of the lower rack of the dishwasher.

It will be apparent to those skilled in the art that many variations and modifications may be made to the present invention without departing from the spirit thereof. Such variations and modifications are included within the intended scope of the claims appended hereto.

What is claimed is:

1. A flexible water deflector member for removable insertion in a socket formed in the base of a dishwasher tub adjacent one edge of the door of the dishwasher, said deflector member comprising a main body having:

a resilient plug removably insertable in said socket, said plug being hollow such as to facilitate insertion and removal from said socket in an interference fit therewith; and having a longitudinal axis; and a flexible deflector portion extending in a cantilevered manner from said plug, said deflector portion generally defining a plane perpendicular to said longitudinal axis.

2. The flexible water deflector member of claim 1 wherein said plug is tapered.

3. The flexible water deflector member of claim 1 wherein said plug is rectangular in cross-section.

4. The flexible water deflector member of claim 1 wherein said main body further comprises a web portion interposed between said plug and said deflector portion in a plane perpendicular to said plane of said deflector portion.

5. The flexible water deflector member of claim 1 wherein said deflector portion is tapered such as to be wider adjacent said plug portion than remote therefrom.

6. The flexible water deflector of claim 1 wherein said main body is formed from a single plastic molding.

7. A dishwasher tub assembly comprising:

a dishwasher tub having an upper wall, a back wall, two side walls, and a lower wall and defining a front opening; and a pair of deflectors fixedly interconnected with said lower wall of said tub, each of said deflectors being disposed adjacent said front opening and one of said side walls, and each of said deflectors extending from said lower wall toward said front opening in a cantilever fashion, wherein said tub further comprises a track surface adjacent each of said side walls and extending from said back wall partially toward said opening and adapted to receive a dishwasher rack thereon, said deflectors being interconnected with said lower wall such as to extend from said track in a cantilever fashion, wherein each of said deflectors further comprises a flexible flat tongue portion having a top surface substantially co-planar with said track surface.

8. A dishwasher tub assembly comprising:

a dishwasher tub having an upper wall, a back wall, two side walls, and a lower wall and defining a front opening; and a pair of deflectors fixedly interconnected with said lower wall f said tub, each of said deflectors being disposed adjacent said front opening and one of said side walls, and each of said deflectors extending from said lower wall toward said front opening in a cantilever fashion, wherein said tub further comprises a pair of sockets formed in said lower wall and each of said deflectors further comprises a plug removably insertable in one of said sockets for fixedly interconnecting said deflectors with said tub.

9. The dishwasher tub assembly of claim 8 wherein said plug forms an interference fit in said socket.

10. The dishwasher tub assembly of claim 9 wherein said plug is hollow such as to facilitate insertion and removal while inhibiting inadvertent removal from said socket.

11. The dishwasher tub assembly of claim 8 wherein each said socket has an axis disposed parallel to said side wall.

12. The dishwasher tub assembly of claim 11 wherein each of said deflectors further comprises a flat cantilevered deflector portion extending perpendicular to said axis in a cantilever manner from said plug toward said opening.

13. The dishwasher tub assembly of claim 12 further comprising a web portion extending between said deflector portion and said plug in a plane perpendicular to said deflector portion, said lower wall of said dishwasher further comprising a slot therein adjacent each of said sockets for passage therethrough of said web portion when said plug is inserted in said socket.

14. The dishwasher tub assembly of claim 13 wherein said slot in said lower portion extends from said socket into said tub such as to facilitate drainage of water from said socket into said tub.

15. The dishwasher tub assembly of claim 8 wherein said socket is rectangular in cross-section.

16. The dishwasher tub assembly of claim 8 wherein said socket and said plug are tapered.

17. A dishwasher assembly comprising:

a tub having an upper wall, a lower wall, a rear wall, and two side walls and defining a front opening;

a door moveably interconnected with said tub such as to selectively form a front wall for said tub by covering said front opening thereof; and a pair of deflectors fixedly interconnected with said lower wall, adjacent said door, each of said deflectors being disposed adjacent one of said sidewalls and extending in a cantilever manner towards said door;

wherein said tub further comprises a pair of vertically disposed rectangular tapered sockets and each side of said pair of deflectors comprises a rectangular tapered plug removably inserted in said sockets such as to form an interference fit therein.

18. The dishwasher tub assembly of claim 17 wherein said plug is hollow such as to facilitate insertion and removal while inhibiting inadvertent removal from said socket.

19. The dishwasher tub assembly of claim 17 further comprising a web portion extending between said deflector portion and said plug in a plane perpendicular to said deflector portion, said lower wall of said dishwasher further comprising a slot therein adjacent each of said sockets for passage therethrough of said web portion when said plug is inserted in said socket.

20. The dishwasher tub assembly of claim 19 wherein said slot in said lower wall extends from said socket into said tub such as to facilitate drainage of water form said socket into said tub.

* * * * *